US009655453B2

(12) United States Patent
Starck

(10) Patent No.: US 9,655,453 B2
(45) Date of Patent: May 23, 2017

(54) DIRECTOR'S CHAIR

(71) Applicant: Philippe Starck, Paris (FR)

(72) Inventor: Philippe Starck, Paris (FR)

(73) Assignee: MAGIS S.P.A., Torre di Mosto (IT)

( * ) Notice: Subject to any disclaimer, the term of this patent is extended or adjusted under 35 U.S.C. 154(b) by 89 days.

(21) Appl. No.: 14/940,457

(22) Filed: Nov. 13, 2015

(65) Prior Publication Data

US 2016/0302575 A1 Oct. 20, 2016

(30) Foreign Application Priority Data

Apr. 14, 2015 (IT) ..... VE2015U0011

(51) Int. Cl.
*A47C 4/28* (2006.01)

(52) U.S. Cl.
CPC ..... *A47C 4/283* (2013.01)

(58) Field of Classification Search
None
See application file for complete search history.

(56) References Cited

U.S. PATENT DOCUMENTS 4,025,088 A * 5/1977 Rothschild ..... A61G 5/08 280/42
4,101,143 A * 7/1978 Sieber ..... A61G 5/00 188/2 F
4,270,795 A * 6/1981 Warren ..... A47C 4/283 297/45
4,371,183 A * 2/1983 Dion ..... A61G 5/08 280/250.1
4,515,383 A * 5/1985 Minnebraker ..... A61G 5/08 280/250.1
4,595,212 A * 6/1986 Haury ..... A61G 5/00 280/250.1
4,721,321 A * 1/1988 Haury ..... A61G 5/128 280/250.1
2011/0227373 A1* 9/2011 Cone, II ..... B62B 7/08 297/16.1

* cited by examiner

*Primary Examiner* — David E Allred
(74) *Attorney, Agent, or Firm* — Themis Law

(57) ABSTRACT

A director's chair includes two sides each having a pair of legs, a rail connecting the upper ends of the pair of legs and, together with an opposing rail, engaging a first canvas that provides a seat, an armrest coupled to a stile, which, together with an opposing stile, engages a canvas that provides a back, a T-shaped strut having a shorter arm rotatably coupled to the lower ends of the pair of legs and a larger arm having at one end a slider slidably engaged in a groove defined in the support rod of an opposing armrest, and a blocking member that prevents an upward movement of the slider within the groove when the director's chair is in open configuration and that can be removably disengaged by the user to bring the director's chair in closed configuration.

4 Claims, 3 Drawing Sheets

DIRECTOR'S CHAIR

FIELD OF THE INVENTION

The present invention relates to a chair. More particularly, the present invention relates to a chair of the kind known as director's chair.

BACKGROUND OF THE INVENTION

Chairs of the kind known as director's chairs are known and generally include one or more pairs of legs, which are composed by two bars that are articulated in crosswise pattern and have upper ends supporting a frame of a canvas seat, and further include two armrests, which extend into two vertical stiles connected by a canvas back.

In these chairs, the changeover from the open to the closed configuration is generally achieved with stretchers and hinges that connect the legs but do not provide a pleasing aesthetic appearance.

SUMMARY OF THE INVENTION

It is an object of the invention to eliminate these drawbacks and provide a director's chair that has a pleasing aesthetic appearance and at the same time enables a simple and easy changeover from the open to the close configuration.

This object is achieved by a director's chair as described hereinafter.

BRIEF DESCRIPTION OF THE DRAWINGS

The present invention is further explained with reference to the enclosed drawings, in which.

DETAILED DESCRIPTION OF EMBODIMENTS OF THE INVENTION

Figure 1:
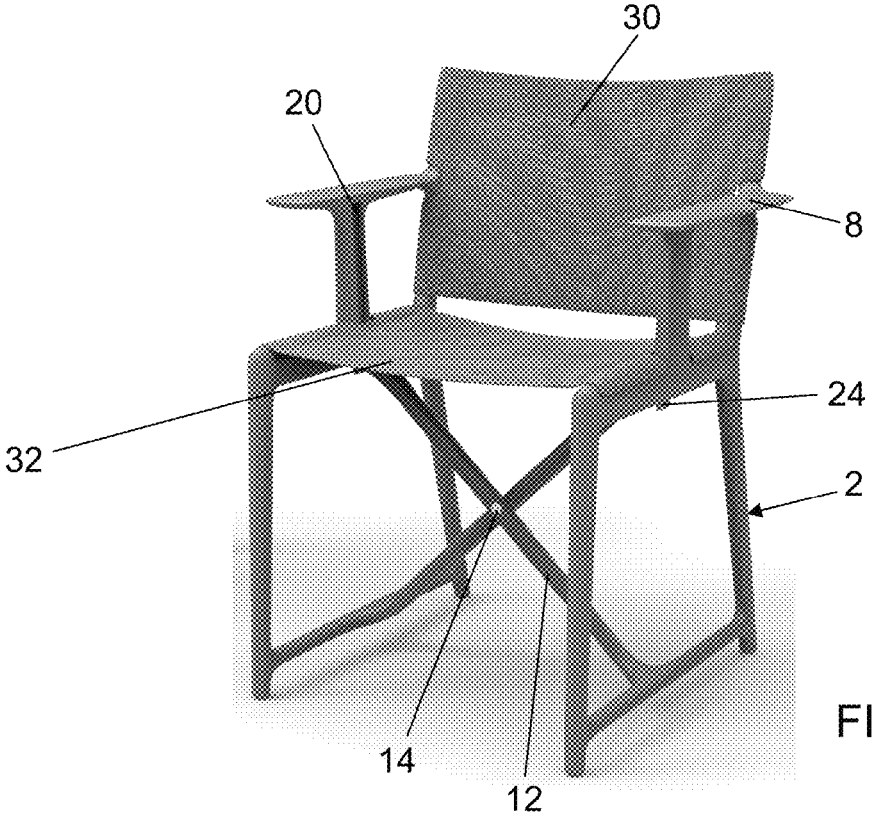
FIG. 1 illustrates a perspective view of a director's chair according to the invention in open configuration.
Figure 2:
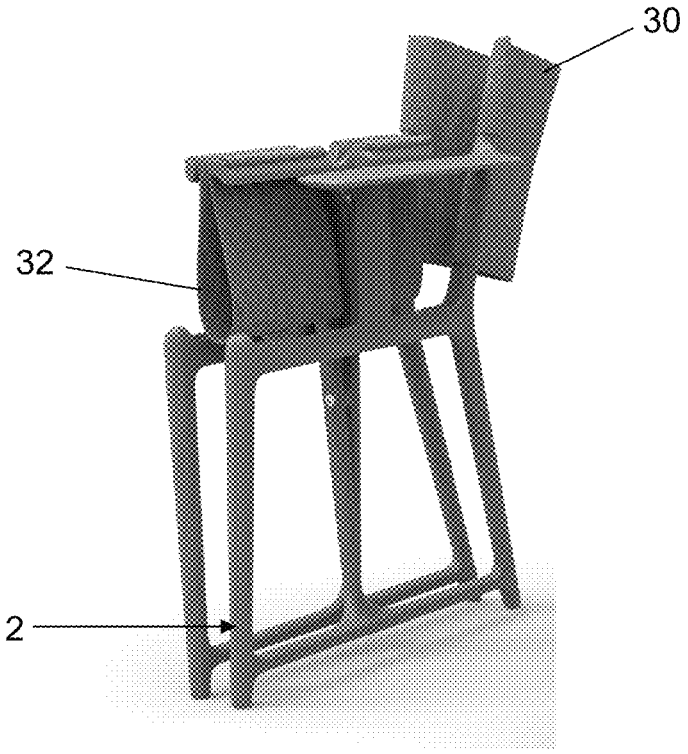
FIG. 2 illustrates the director's chair of FIG. 1 in closed configuration.
Figure 3:
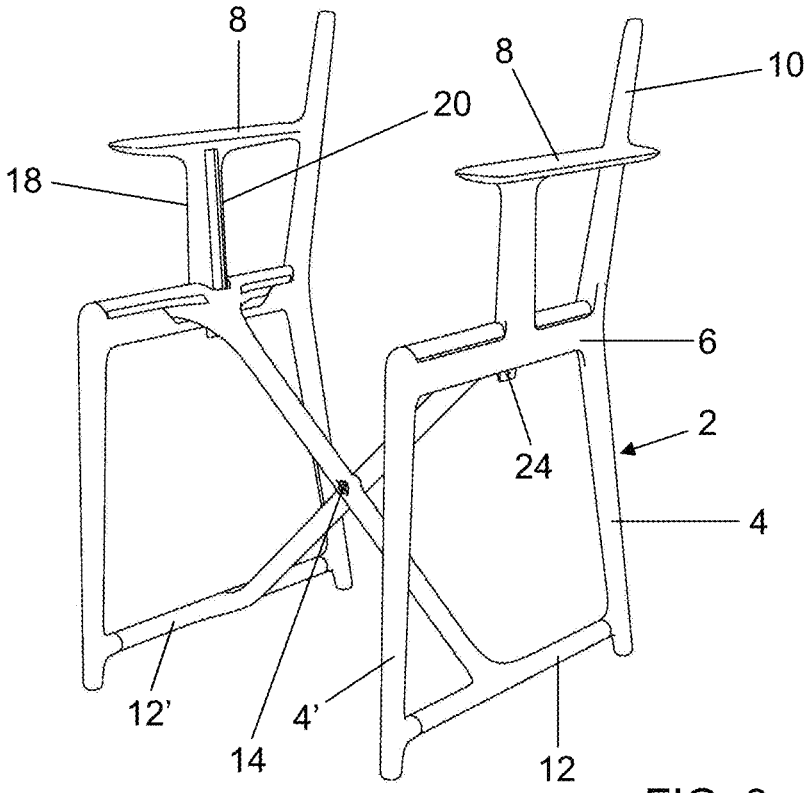
FIG. 3 illustrates the director's chair of FIG. 1 without seat and back.
Figure 4:
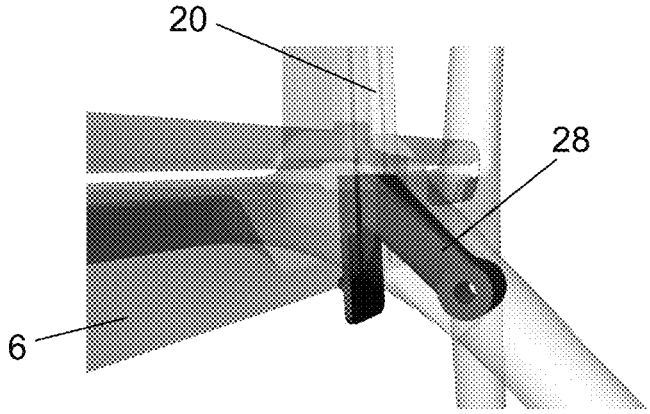
FIG. 4 illustrates a blocking system of a director's chair as in FIG. 1 in open configuration.
Figure 5:
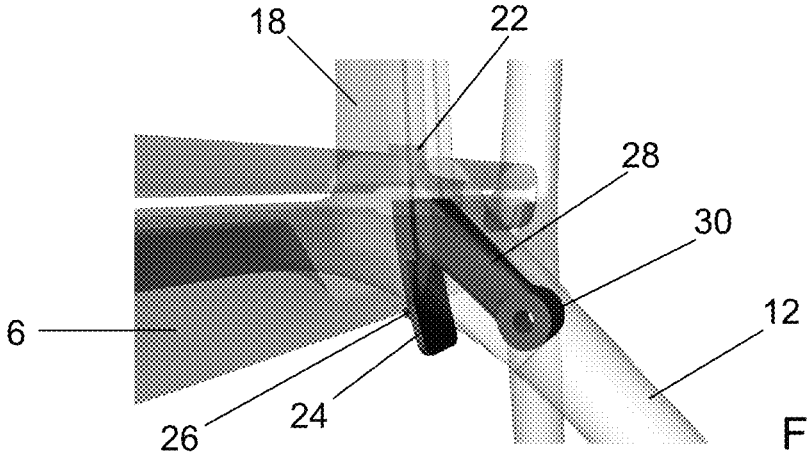
FIG. 5 illustrates a detailed view of a slider of a director's chair as in FIG. 1 during unblocking.
Figure 6:
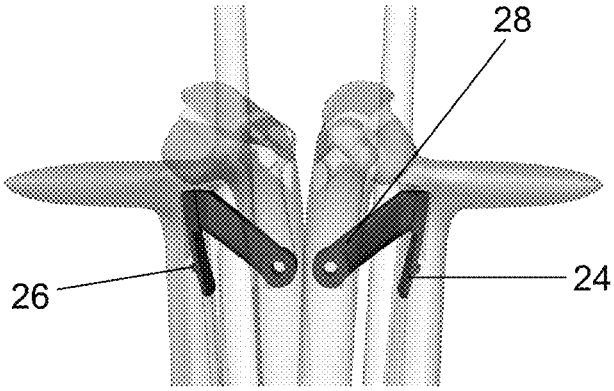
FIG. 6 illustrates the structure of a director's chair as in FIG. 1 in closed configuration.

As it can be seen from the drawings, a director's chair according to the invention includes two sides 2, each having:

two legs 4, 4' that are upperly connected by a rail 6;

an armrest 8 connected to rail 6;

a stile 10 connected to armrest 8.

A T-shaped strut 12 is rotatably coupled to each lower end of the couple of legs 4, 4' and is further articulated to a second strut 12' with a pivot 14.

Each armrest 8 is coupled to rail 6 with a support rod 18 having a T-shaped groove 20 therein, in which a slider 22 is slidably disposed.

Slider 22 extends lowerly to form elastic tab 24, which has a tooth 26 that elastically cooperates with the lower edge of rail 6 in the open chair configuration.

Slider 22 is integrally joined at an upper end to an appendage 28 having an end with an opening 30 configured to engage an articulating pivot (not shown in the drawings) provided at the upper end of struts 12, 12'.

Stiles 10 are joined by a canvas 30 that provides the back of the chair, and the two rails 6 are joined by a canvas 32 that provides the seat.

Operation of a director's chair according to the invention is as follows:

in the open configuration, with sides 2 spread apart, slider 22 is disposed at the bottom of groove 20 and tooth 26 of tab 24 engages the lower edge of rail 6, such to prevent an upward return of slider 22 when a user sits on canvas 32.

When the chair is to be folded to bring it to the closed configuration, the user grasps tab 24 such to disengage tooth 26 from rail 6 and, therefore, enable the upward return of slider 22 within groove 20, thereby causing struts 12, 12' to rotate in relation to pivot 14 and the two sides to approach.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become obvious to those skilled in the art and the scope of the present invention is limited only by the appended claims.

The invention claimed is:

1. A director's chair having two sides (2) each comprising:

a pair of legs (4, 4');

a rail (6) connecting upper ends of the pair of legs (4, 4'), wherein in an open configuration the rail and an opposing rail engage a first canvas (32) that provides a seat; and an armrest fixed to the rail by a support rod and a first stile, the stile and an opposing stile engaging a second canvas that provide a back, wherein a T-shaped strut (12, 12'), having a shorter arm that is rotatably coupled to lower ends of the pair of legs (4, 4') and a larger arm with a slider (22) coupled to one end thereof, is slidably engaged in a groove (20) defined in a support rod (18) of an armrest (8) of an opposing side, and wherein the slider (22) comprises a blocking member (26) that prevents an upward movement of the slider within the groove (22) when the director's chair is in the open configuration, the blocking member (26) being configured to be removably released as desired by a user to bring the director's chair in a closed configuration.

2. The director's chair according to claim 1, wherein the groove (20) is T-shaped.

3. The director's chair according to claim 1, wherein the slider (22) and the blocking member (26) are configured as a single piece.

4. The director's chair according to claim 1, wherein the blocking member is configured as a tooth (26) cooperating with a rail (6) of the opposing side.

* * * * *